United States Patent [19]

Schmidt

[11] Patent Number: 4,915,309

[45] Date of Patent: Apr. 10, 1990

[54] ROTOR FOR A REBOUND CRUSHER

[75] Inventor: Horst H. Schmidt, Bergisch-Gladbach, Fed. Rep. of Germany

[73] Assignee: Deutscher SBM Vertrieb Franz Wageneder, Hagen, Fed. Rep. of Germany

[21] Appl. No.: 283,636

[22] Filed: Dec. 13, 1988

[30] Foreign Application Priority Data

Dec. 15, 1987 [DE] Fed. Rep. of Germany ..... 3742395

[51] Int. Cl.[4] ..... B02C 13/26; B02C 13/28

[52] U.S. Cl. ..... 241/191; 241/197

[58] Field of Search ..... 241/191, 192, 197

[56] References Cited

U.S. PATENT DOCUMENTS

| | | | |
|---|---|---|---|
| 3,979,078 | 9/1976 | Böddeker et al. | 241/197 X |
| 4,180,213 | 12/1979 | Endo | 241/192 |
| 4,679,740 | 7/1987 | Orphall | 241/192 X |
| 4,720,052 | 1/1988 | Hasenfuss et al. | 241/192 |

FOREIGN PATENT DOCUMENTS

| | | |
|---|---|---|
| 209757 | 6/1986 | European Pat. Off. . |
| 2147920 | 9/1971 | Fed. Rep. of Germany . |
| 2412508 | 9/1975 | Fed. Rep. of Germany . |
| 7911613 | 4/1979 | Fed. Rep. of Germany . |

*Primary Examiner*—Timothy V. Eley

*Attorney, Agent, or Firm*—Sprung Horn Kramer & Woods

[57] ABSTRACT

The invention relates to a rotor for a rebound crusher in which the beater blades (5), retained in marginal recesses (4) in rotor discs (3) are positively retained by an axial locking system (7, 8) disposed on the rear side of the beater blades (5). On the front side of the beater blades (5) protective caps (10) are disposed on the discs (3) to maintain the axial positive locking system (7, 8) and protect the discs (3). To secure the beater blades (5) against axial displacement, the beater blades (5) are secured by a positive locking system comprising a recess (22) and a nose (21) engaging therein with clearance. To keep the protective cap (10) free from loading by the beader blade (5), in the side of the protective cap (10) adjacent the beater blade (5) a window (24) is provided into which a projection (15) of the disc (3) extends which forms an abutment (16) for a bearing surface (17) of the beater blade (5).

5 Claims, 1 Drawing Sheet

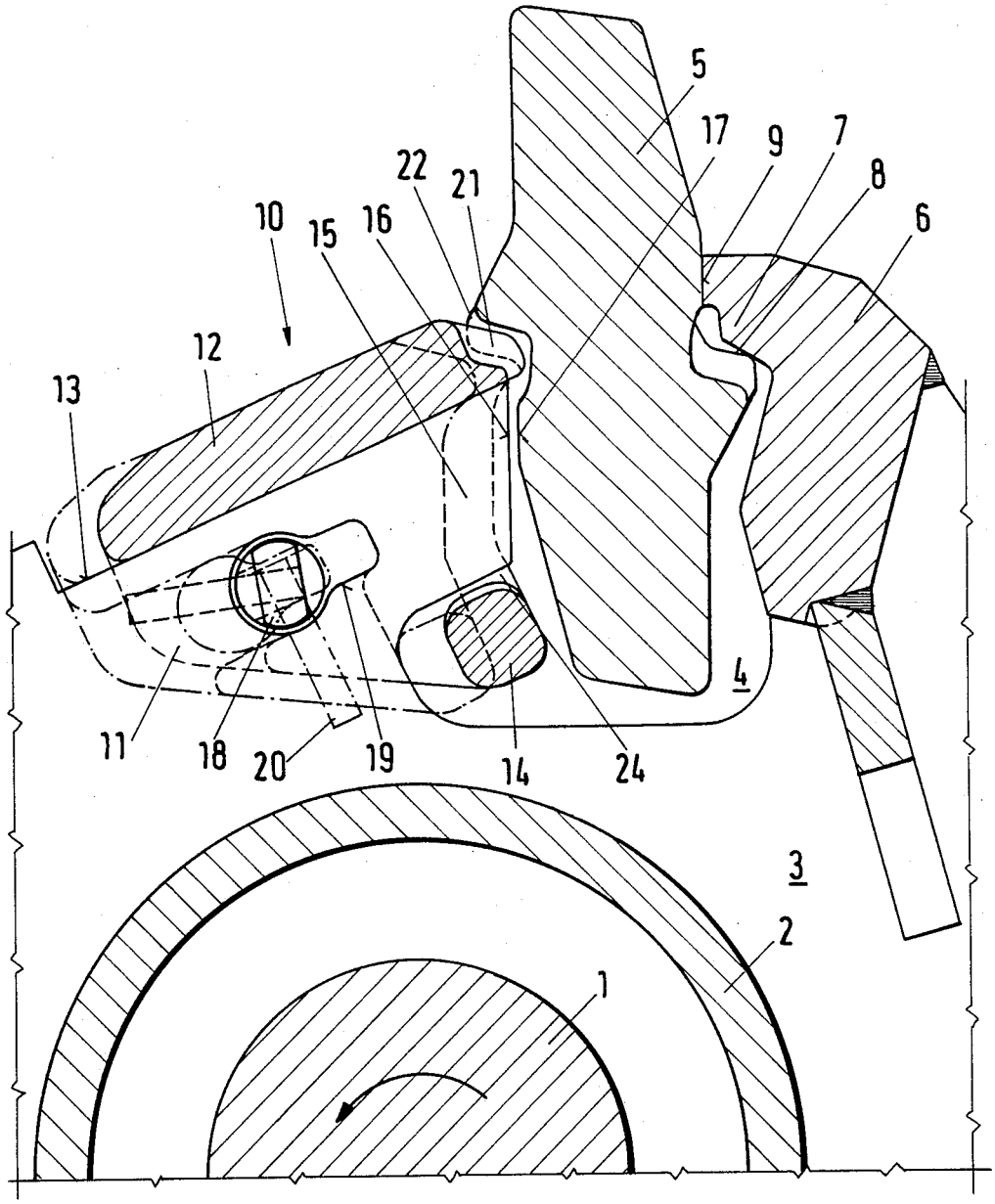
5
17
9
7
8
6
22
21
10
15
16
12
13
11
18
20
19
14
24
4
3
2
1

ROTOR FOR A REBOUND CRUSHER

BACKGROUND OF THE INVENTION

1. Field of the invention

The invention relates to a rotor for a rebound or impact crusher, comprising a number of discs disposed axially spaced out on a shaft, and beater blades which are disposed in marginal recesses in the discs and are each retained by an axially extending positive locking system provided between their rear side and the discs and on whose front sides directly by protective caps disposed on the discs.

2. Discussion of Prior Art

In a prior art rotor of the kind specified the beater blade is rigidly clamped between a supporting beam forming the rear-side locking system and the protective cap bearing directly against the beater blade on the front side. In that prior art rotor, therefore, the protective caps must not only retain the beater blades positively connected to the discs on the rear-side and protect the discs on the front side of the beater blade against the material to be crushed, but they must also support the beater blades when they are loaded by the material for crushing. In this prior art the beater blades are not secured axially (German OS 21 47 920).

In a different kind of prior art rotor the beater blades are also rigidly clamped in the discs, but not by directly bearing against the protective cap, but bearing against a clamping wedge clamped between the protective cap and the beater blade. It is true that in the last-mentioned prior art the beater blades are not supported directly on the protective caps, as in the previously-mentioned prior art, but are supported only indirectly via the clamping wedges; nevertheless, when the beater blades are loaded by the material for crushing, the protective caps must bear the forces acting on the beater blades (German Patent 24 12 508 B2).

In another prior art rotor the beater blades are positively retained by an axially extending spring-and-groove locking system on both the front and rear sides. The spring-and-groove locking system on both the rear and front sides consists of a rod which engages in the groove and extends over the whole rotor length. The front side rod is retained by protective plates screwed onto the discs. To secure them against axial displacement, the beater blades can be formed with recesses which are advantageously disposed on the rear side of the beater blade. Similarly to the other prior art rotor, in this case also the means disposed on the front side of the beater blade to fix the beater blade are loaded thereby when the lade is loaded by the material to be crushed (European Patent 0 209 757 A2).

Lastly, a rotor is known in which the beater blade engages positively on the rear side via a round rod engaging in a trough-shaped recesses and on the front side via an attachment formed on claming wedges of the protective cap and engaging in a trough-like recess in the beater blade. Due to this retaining system, when the rotor is stationary the beater blade is retained relatively loosely in the discs and is in practice merely secured against dropping out, while when the rotor rotates and centrifugal force is operative, the beater blade bears against the clamping wedge. In this rotor also, therefore, a part of the protective cap, mainly the clamping wedge, performs the function of bearing the loading of the beater blade by material for crushing (German Utility Model 79 11 613).

SUMMARY OF THE INVENTION

It is an object of the invention to provide a rotor for a rebound crusher in which apart from their protective function the protective claps solely perform a securing function for the beater blades.

To this end, in a rotor of the kind specified according to the invention with the protective cap in the locking position, each beater blade is secured against axial displacement by a positive locking system, formed by the protective cap and the beater blade and comprising a recess and a nose engaging in the recess with clearance, and has on its front side a bearing surface, for which an abutment is provided which is formed by one side of the marginal recess and is freely accessible via an opening in the protective cap.

According to the invention the protective cap performs no supporting function, but merely a securing function, since on its front side the beater blade can bear directly against the disc. The nose engaging with clearance in a recess gives the beater blade a certain mobility until it bears against the abutment, without the protective cap being loaded, while due to the absence of substantial forces the beater blades are also reliably secured against displacement axially, again without loading the protective cap.

According to one feature of the invention with the locking system maintained, each protective cap is mounted for limited displacement on the disc in the direction of the beater blade. Very advantageously due to the position of guiding means for the displaceable protective cap, the cap is acted upon by a component of centrifugal force in the direction of the beater blade. This feature ensures that the protective cap automatically takes up the optimum locking position, but the cap can yield practically free from force when the beater blade moves in the direction of the abutment and abuts the protective cap.

According to another feature of the invention each protective cap is substantially U-shaped, the two arms bearing against the sides of the disc and their front ends adjacent the beater blade being interconnected via a web which in the marginal recess engages behind a projection forming the abutment. As a result of this feature the protective cap is reliably retained with limited displaceability, without further elements being required. No further securing is required in operation, because the component of centrifugal force in any case retains the protective cap in the locked position. An additional locking element can be provided solely for securing purposes when the crusher is stationary. According to another possible feature of the invention, to this end each protective cap is secured against displacement on the disc by a rotary bolt which extends through the arms and the disc and engages by a portion flattened on both sides at both ends in keyhole-shaped recesses in the arms. In dependence of the position of the rotary bolt, the protective cap is retained in the locked position or in the unlocked position for the beater blade.

DESCRIPTION OF AN EMBODIMENT OF THE INVENTION

The invention will now be described in greater detail with reference to a drawing, which shows a cross-sectional detail through a rotor in the plane of the end face of a disc.

Disposed axially spaced out on a shaft 1 driven in a direction indicated by an arrow and enclosed by a protective tube 2 are a number of identical discs 3. The discs 3 are formed with marginal recesses 4 which are aligned with one another in the axial direction and in which beater blades 5 extending over the whole length of the rotor are retained. On their rear sides the beater blades 5 bear against supporting bars 6, which are welded to the discs 3 and also extend over the whole length of the rotor. By an arm 7 each supporting bar 6 engages behind a projection 8, thus positively securing the beater blade 5 in the radial direction of the discs 3, and acts as a bearing for the beater blade 5 at a place 9.

Disposed on the disc 3 is a U-shaped protective cap 10. Its two arms 11 bear against the sides of the disc 3, while a plate 12 interconnecting the two arms 11 is borne on an inclined flat guiding surface 13 of the disc periphery. At their ends remote from the plate 12, the arms 11 are interconnected via a web 14 on the side adjacent the beater blade 5. A web 14, the arms 11 and the plate 12 form a frame for a window-like opening 24 in which a protection 15 of the disc 3 engages which at its front side 16 forms an abutment for the supporting surface 17 on the front side of the beater blade 5.

Keyhole-shaped openings 19 are provided in the two arms 11 for a rotary bolt 18 which is flattened on both sides at its two ends and engages through the two arms 11 and disc 3. The rotary bolt 18 is secured by dowel pins extending through the two ends. The protective cap 10 can be displaced or is secured against displacement with a clearance in dependence on the rotated position of the rotary bolt 18.

The plate 12 has at it's edge adjacent the beater blade 5 a nose 21 which engages in a recess 22 in the step-shaped projection 8. This interengagement of the nose 21 and the projection 22 secures the beater blade 5 in the axial direction.

In the position of the protective cap 10 shown in solid lines in the drawing the cap 10 is in the locked position. In this position enough clearance for the free movement of the beater blade 5 is left between the front edge of the nose 21 and the bottom of the recess 22, while maintaining the positive locking. The protective cap 10 is retained with clearance by the locking bolt 18, and in the collaboration of the web 14 with the projection 15 the protective cap 10 has a degree of freedom in the direction of the beater blade 5.

When the rotor rotates, a component of the centrifugal force acts on the protective cap 10 in the direction of the beater blade 5 according to the inclination of the guiding means 13, 14, 15, 24. By its nose 21, therefore, the protective cap 10 can hunt for the optimum locking position in the recess 22. However, since the component of force is not large enough, the protective cap 10 can also be repelled without a substantial loading by the beater blade 5 until the supporting surface 17 thereof abuts the abutment 16. The protective cap 10 cannot therefore be substantially loaded by the beater blade 5.

To demount the beater blade 5, the flattened ends of the rotary bolt 18 are aligned with the slot of the keyhole-shaped recess 19. After alignment the protective cap 10 can be moved out of the position shown in solid lines in the drawing into the position shown in chain lines in the drawing. In this position the nose 21 and the recess 22 are no longer in engagement. The beater blade 5 can then be withdrawn axially from the marginal recess 14.

I claim:

1. A rotor for a rebound crusher, comprising a shaft, axially spread apart discs mounted on the shaft and having marginal recesses therein, beater blades having front and rear sides disposed in the marginal recesses and means for securing the blades in the marginal recesses, comprising position locking means disposed between the rear sides of the blades and the discs for preventing radial displacement of the blades, protective caps disposed on the discs at the front sides of the blades and means for mounting the protective cap in a locking position to prevent axial displacement comprising a locking recess in the front side of each blade, a nose on each protective cap engaging in the locking recess with clearance, a bearing surface on each protective cap and facing the marginal recess and means forming an abutment in the marginal recess for the bearing surface.

2. A rotor according to claim 6, wherein each protective cap is mounted for limited displacement on the disc in the direction of the beater blade.

3. A rotor according to claim 2, further comprising guiding means for each protective cap for effecting action on the cap by a component of centrifugal force in the direction of the beater blade.

4. A rotor according to claim 6, wherein each protective cap is substantially U-shaped with two arms bearing against sides of each disc and front ends adjacent the beater blade interconnected with a web engageable with the means forming the abutment in the marginal recesses.

5. A rotor according to claim 4, further comprising a rotary bolt securing each protective cap against displacement on the disc, wherein the rotary bolt extends through the arms and the disc and has a portion flattened on both sides at both sides ends and extends in keyhole-shaped recesses in the arms.

* * * * *